US011067272B2

(12) United States Patent
Hong

(10) Patent No.: US 11,067,272 B2
(45) Date of Patent: Jul. 20, 2021

(54) TANDEM FLARE

(71) Applicant: FLARE INDUSTRIES, LLC, Austin, TX (US)

(72) Inventor: Jianhui Hong, Buffalo Grove, IL (US)

(73) Assignee: Cimarron, Houston, TX (US)

( * ) Notice: Subject to any disclaimer, the term of this patent is extended or adjusted under 35 U.S.C. 154(b) by 191 days.

(21) Appl. No.: 16/393,287

(22) Filed: Apr. 24, 2019

(65) Prior Publication Data

US 2020/0340671 A1 Oct. 29, 2020

(51) Int. Cl.

| | |
|---|---|
| ***F23G 7/08*** | (2006.01) |
| ***F23D 14/58*** | (2006.01) |
| ***F23D 14/08*** | (2006.01) |

(52) U.S. Cl.

CPC ..... *F23G 7/085* (2013.01); *F23D 14/08* (2013.01); *F23D 14/58* (2013.01)

(58) Field of Classification Search

CPC ... F23G 7/085; F23G 7/08; F23G 7/06; F23G 2209/14; F23D 14/58; F23D 14/08; F23D 14/20

See application file for complete search history.

(56) References Cited

U.S. PATENT DOCUMENTS 3,709,654 A * 1/1973 Desty ..... F23G 7/08 431/284
3,822,984 A * 7/1974 Straitz, III ..... F23G 7/08 431/283
3,833,337 A * 9/1974 Desty ..... F23G 7/08 431/284
4,036,580 A 7/1977 Reed et al.
4,099,908 A * 7/1978 Beckmann ..... F23D 14/62 431/284
4,116,618 A * 9/1978 Straitz, III ..... F23G 7/085 239/404
4,154,572 A * 5/1979 Reed ..... F23L 7/005 431/202
4,269,583 A 5/1981 Straitz, III
4,336,017 A 6/1982 Desty
(Continued)

FOREIGN PATENT DOCUMENTS

EP 0153866 A2 9/1985

OTHER PUBLICATIONS

Reid, Scott F, Benefits of Pressure-Assisted Flares, John Zink Company, LLC paper for presentation at 2016 4C HSE Conference, Mar. 6, 2016, John Zink Hamworthy Combustion.

*Primary Examiner* — Jorge A Pereiro
(74) *Attorney, Agent, or Firm* — Jiahui Hong

(57) ABSTRACT

A flare tip for discharging and burning high pressure and low pressure flare gas is provided. A cover is positioned over the upper end of a first pipe through which a high pressure waste gas stream flows. The configuration of the cover allows the high pressure waste gas to burn smokelessly. The upper end of a second pipe that is concentrically positioned around the first pipe is positioned at a lower elevation than the upper end of the first pipe, and the outer edge of the second pipe is tangential to the flat bottom portion of the cover. When the waste gas exiting the upper end of the first pipe does not have sufficient force to raise the cover off the upper end of the first pipe, the flat bottom portion of the cover forms a cap over the upper end of the first pipe while the upper end of the second pipe remains open.

12 Claims, 5 Drawing Sheets

(56) References Cited

U.S. PATENT DOCUMENTS

| | | | | |
|---|---|---|---|---|
| 4,344,751 | A * | 8/1982 | Chesters | F23G 7/085 431/202 |
| 4,392,817 | A * | 7/1983 | Berlie | F23G 7/085 422/182 |
| 4,457,696 | A | 7/1984 | Schwartz et al. | |
| 4,464,110 | A | 8/1984 | Boden et al. | |
| 4,486,168 | A | 12/1984 | Pratley | |
| 4,634,370 | A * | 1/1987 | Chesters | F23L 7/002 431/202 |
| 7,967,600 | B2 | 6/2011 | Hong et al. | |
| 2007/0231758 | A1* | 10/2007 | Harless | F23G 7/085 431/202 |
| 2007/0231759 | A1* | 10/2007 | Harless | F23G 7/08 431/202 |
| 2007/0281266 | A1 | 12/2007 | Rajewski | |
| 2010/0291492 | A1 | 11/2010 | Poe et al. | |
| 2014/0329186 | A1* | 11/2014 | McClain | F23G 7/085 431/5 |
| 2014/0329190 | A1* | 11/2014 | McClain | F23J 13/08 431/202 |
| 2015/0211735 | A1 | 7/2015 | Menger et al. | |

* cited by examiner

TANDEM FLARE

BACKGROUND OF THE INVENTION

This invention is in the field of industrial flares used in the combustion of large flows of waste gas and, in particular, elevated open flares having a high pressure waste gas stream and a tandem low pressure waste gas stream.

Traditional Flare Devices

Industrial flares are gas combustion devices commonly used in petroleum refineries, chemical plants and natural gas processing plants, as well as at oil or gas production sites. Such flares are used for disposing of waste gases and other flammable gas streams that are diverted due to venting requirements, shut-downs, upsets or similar events. A typical flare apparatus includes a flare stack, which can extend high above the ground, and a flare tip mounted on the flare stack.

In a typical flare tip, the air and the waste gas, or flare gas, are generally coaxially discharged into the atmosphere. The flare tip then relies on turbulence and diffusion in and around the tip to mix the air and gas sufficiently for a stable combustion process. Unfortunately, such a mixing system may not be as efficient as desired. External atmospheric air on the outside of the flare gas stream can be inhibited from mixing with the flare gas due to wind and other factors.

In addition to the issues associated with the emission of uncombusted waste gas into the atmosphere, there are other reasons why it is important to ensure that the combustion process is as efficient and thorough as possible. For example, it is generally desirable for a number of reasons, including the legal reasons discussed below, for the flare to be free of, or to have very minimal, smoke emissions. To minimize or eliminate the smoke emissions, it is important to admix the flammable gas being discharged with enough air to sufficiently oxidize the gas.

There are several ways to facilitate the mixing of flammable gas and air known in the art, including using either air or steam to assist the mixing of gases. In an air-assist flare, one or more blowers are used to deliver air up through the flare stack, thereby enhancing the availability of air in the combustion zone. In a steam-assist flare, steam is used to provide the necessary motive force to entrain air from around the flare apparatus into the combustion zone.

Legal Requirements

As mentioned above, there are regulations regarding the amount of smoke emissions that may be discharged from a flare in the U.S. The specific regulations are contained in 40 CFR § 60.18 and 40 CFR § 63.11. These regulations require that, for example, (i) each flare must have one or more continuous pilots, (ii) the flare may have no visible emissions, as determined by the methods specified in the regulations, for more than five minutes in every two hours, (iii) flare exit velocity cannot exceed a certain maximum value, which is calculated using a formula that is specified in the regulations and that is dependent on the lower heating value (LHV) of the waste gas, and (iv) the LHV cannot be less than 200 btu/scf for non-assisted flares and the LHV cannot be less than 300 btu/scf for assisted flares. In any case (regardless of LHV values of the flare gas), the maximum exit velocity cannot exceed 400 ft/sec.

Coanda Nozzles

In order to comply with the emissions and other requirements for the proper use of flares, some flares known in the art for disposing of gas or liquid combustible materials include a Coanda body positioned across the outlet of a high pressure line, thereby defining an annular outlet which directs the combustible materials exiting the line over the outer surface of the Coanda body. It is well known that there is a propensity for a fluid stream emerging from an orifice to follow an adjacent flat or curved body and to entrain fluid from the surroundings so that a region of lower pressure develops. This physical phenomenon is known as the Coanda effect, and a body exhibiting this effect is known as a Coanda body. However, even this process fails to adequately mix the air with the high pressure waste gas to reliably ensure sufficient combustion thereby emitting unacceptable amounts of smoke.

There is a need, therefore, for an industrial flare that is capable of disposing both a high pressure waste stream and a low pressure waste stream, and that is more efficient in terms of utility consumption (in terms of electricity or assist gas or steam) than flares known in the art, all while reducing emissions and staying in compliance with applicable federal regulations.

SUMMARY OF THE INVENTION

A flare tip is presented which includes a variable-orifice nozzle having a cover positioned over the upper end of a first pipe through which a high pressure waste gas stream flows. The pressure from the gas stream causes the cover to separate from the upper end of the first pipe thereby forming an orifice which increases in width as the gas pressure increases.

A second pipe is concentrically positioned around the first pipe and the upper end of the second pipe is positioned to be at a lower elevation than the upper end of the first pipe, and the outer edge of the second pipe is tangential to the flat bottom portion of the cover, such that the second pipe is generally the same diameter as the flat bottom portion of the cover. When the high pressure waste gas exiting the upper end of the first pipe does not have sufficient force to raise the cover off the upper end of the first pipe, the flat bottom portion of the cover forms a seal over the upper end of the first pipe, thereby effectively closing the exit of the first pipe while allowing the upper end of the second pipe to remain open.

As the low pressure waste gas stream exits the annulus formed between the first pipe and the second pipe, the low pressure waste gas forms a thin film which facilitates the mixing of ambient air with the low pressure waste gas, thereby reducing the propensity of the gas stream to generate smoke.

To increase the exit velocity of the low pressure waste gas from the second pipe, a horizontal choke plate may be installed at a location near the exit area of the upper end of the second pipe. In some embodiments the choke plate is attached to the first pipe and forms an annulus between the choke plate and the first pipe. The choke plate reduces the exit area of the annulus between the first pipe and the second pipe, thereby increasing the exit velocity of the low pressure waste gas stream.

In some embodiments of the present invention, a larger cylindrical shroud is concentrically positioned around the first pipe, the second pipe, the igniter and at least a portion of the cover. The shroud constitutes the outer shell of the flare for purposes of calculating, for example, the exit velocity of gas flowing through the flare to establish compliance with applicable laws. In addition to forming the outer shell of the flare tip, the addition of the shroud allows ambient air to be drawn into the shroud from the bottom opening of the shroud by the induction effect of the high pressure waste gas.

The foregoing has outlined rather broadly certain aspects of the present invention in order that the detailed description of the invention that follows may better be understood. Additional features and advantages of the invention will be described hereinafter which form the subject of the claims of the invention. It should be appreciated by those skilled in the art that the conception and specific embodiment disclosed may be readily utilized as a basis for modifying or designing other structures or processes for carrying out the same purposes of the present invention. It should also be realized by those skilled in the art that such equivalent constructions do not depart from the spirit and scope of the invention as set forth in the appended claims.

DESCRIPTION OF THE DRAWINGS

For a more complete understanding of the present invention, and the advantages thereof, reference is now made to the following descriptions taken in conjunction with the accompanying drawings, in which.

DESCRIPTION OF THE PREFERRED EMBODIMENTS

The present invention is directed to improved methods and systems for, among other things, industrial flares. The configuration and use of the presently preferred embodiments are discussed in detail below. However, it should be appreciated that the present invention provides many applicable inventive concepts that can be embodied in a wide variety of contexts other than industrial flares. Accordingly, the specific embodiments discussed are merely illustrative of specific ways to make and use the invention, and do not limit the scope of the invention. In addition, the following terms shall have the associated meaning when used herein:

"cover" means any form of bowl shaped apparatus, whether hollow or solid, that is capable of creating a cap or seal over the upper end of the first pipe;

"high pressure" means more than 12 psig;

"low pressure" means less than 1 psig; and

"pipe" means a tube, conduit, hose, main, duct, line, pipeline, drain, tubing, piping, siphon, cylinder or similar device;

"waste gas" means natural gas or any other gas generated as a byproduct of the processes in petroleum refineries, chemical plants and natural gas processing plants, as well as at oil or gas production sites.

Figure 1:
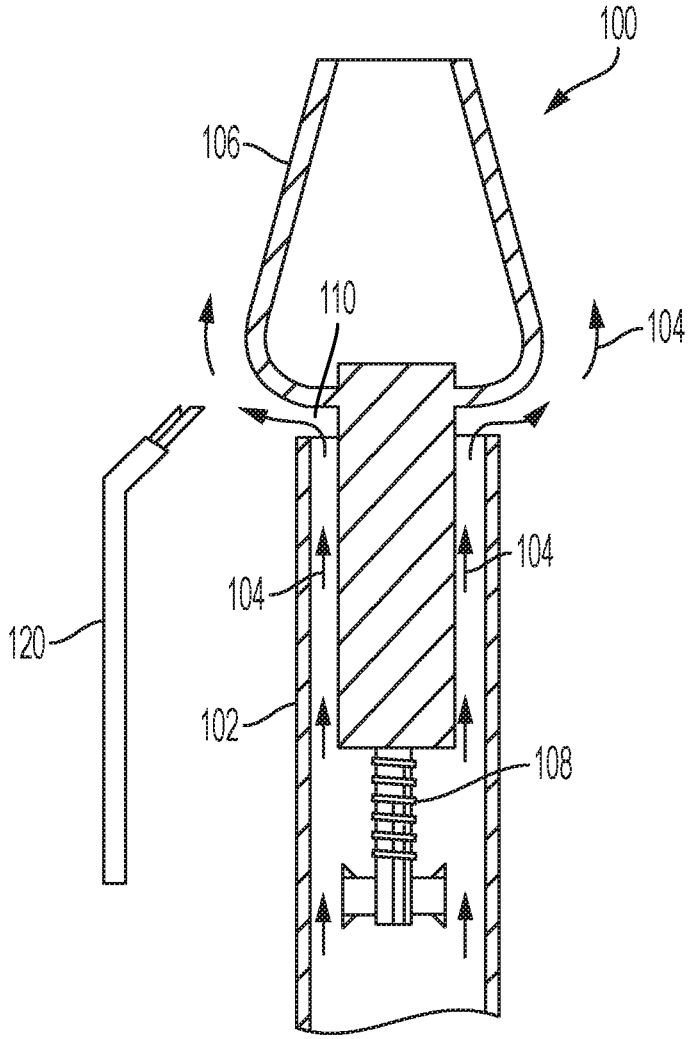
FIG. 1 is a diagram of a Coanda flare known in the art having a high pressure gas supply pipe.

Referring now to FIG. 1, which shows a variable-orifice Coanda flare 100 known in the art having a first pipe 102 and a Coanda body 106 movably attached to the upper end of the first pipe 102. Coanda body 106 consists of a flat bottom portion and an optional conical section on upper end of the flat bottom portion. An annular orifice 110 is provided between the upper end of the first pipe 102 and the bottom of the Coanda body 106 through which pressurized flammable high pressure waste gas 104 flows. At high pressures, the orifice 110 is at its maximum gap size and the gas 104 exits the orifice 110 at a high velocity such as, for example, sonic velocity. The high velocity of gas 104 provides motive momentum and mixing energy to ensure a smokeless flame. At low pressures, the orifice 110 is reduced to a smaller gap (sometimes nearly zero), allowing the gas 104 to form a thin film around the Coanda body. At low pressures, exit velocity is relatively low, but the small thickness of the gas film facilitates mixing with ambient air, resulting in a smokeless flame. An igniter 120 with a pilot flame is positioned to ignite the gas and air mixture.

In some instances, a spring 108 is configured to maintain the Coanda body 106 proximal to the upper end of the first pipe 102 until the pressure of the flammable high pressure waste gas 104 exerts enough force to lift the Coanda body 106 away from the upper end of the first pipe 102. The greater the force exerted by the gas 104, the larger the size of the orifice 110. In some variations, it may be desirable to include a mechanical stop to limit the amount the Coanda body 106 can be raised above the upper end of the first pipe 102. In one embodiment, the high pressure first pipe is an eight inch schedule 40 pipe, and the gap size of the orifice 110 varies between zero inches and one inch. This gap size is the vertical travel distance that the Coanda body 106 is moved from the "close" position where Coanda body 106 is seated tightly against the upper end of first pipe 102.

Referring back to FIG. 1, the Coanda body 106 may be at or near the upper end of the first pipe 102 when the flammable high pressure waste gas 104 pressure is very low. Depending on the force exerted by the spring 108, when gas 104 pressure increases to a preset value, such as, for example, 8 psig, the upward force exerted by the gas 104 overcomes the downward force exerted by the spring 108 and the Coanda body 106 separates from the upper end of the first pipe 102. As the gas 104 pressure increases further, such as, for example, 18 psig, the upward force exerted by the gas 104 causes the orifice 110 to open to its maximum desired position whereupon a mechanical stop (not shown) may prevent the orifice 110 from opening further.

Figure 2:
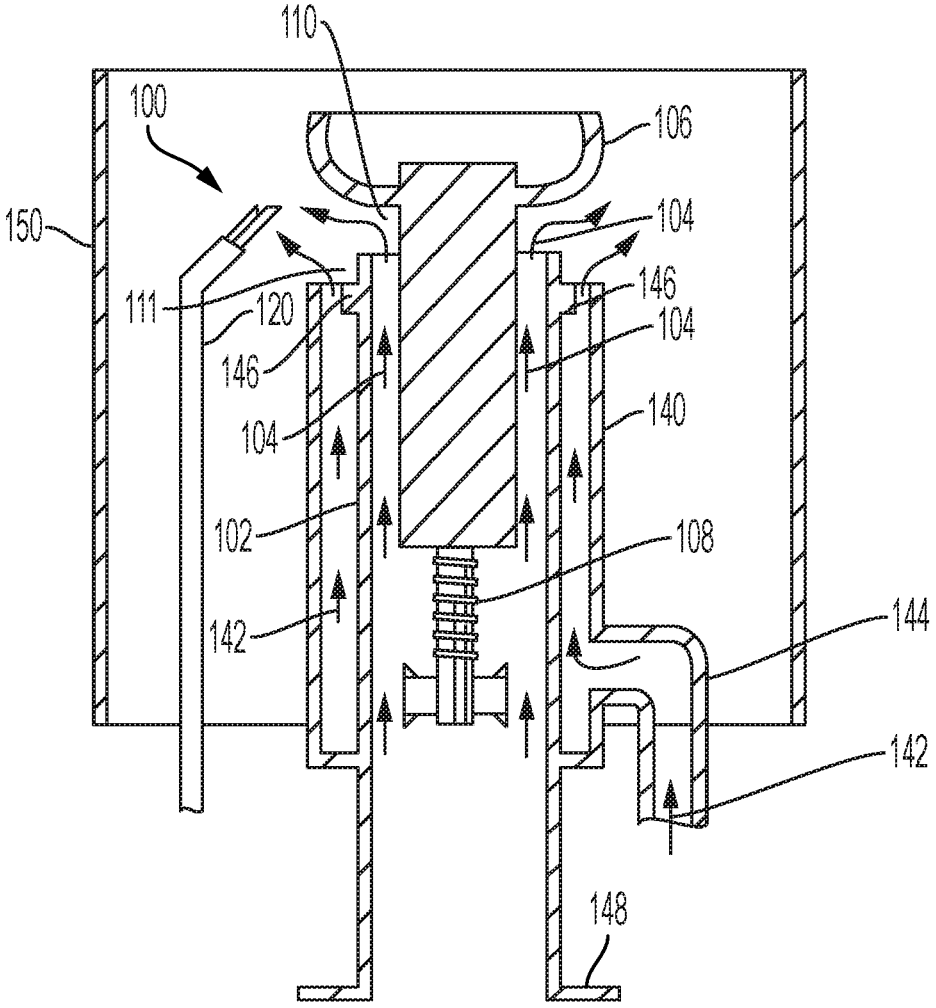
FIG. 2 shows one embodiment of a flare tip of the present invention.

Referring now to FIG. 2 which depicts one embodiment of the flare tip of the present invention. The flare tip is shown with a flanged lower portion 148, although the flare tip may be affixed to the end of the flare through any other means known in the art. The axis of the flare tip is generally positioned in a vertical orientation, although it may be oriented at a slight angle of a few degrees if desired. It will also be appreciated by those familiar with the environments in which flares operate that wind and other factors may cause the flare to be angled slightly during operation.

The first pipe 102 has an upper end and a lower end, and a variable-orifice nozzle, such as that described above, having a cover 106 is positioned over the upper end of a first pipe 102. A high pressure waste gas 104 stream flows upward through the first pipe 102. The pressure from the high pressure waste gas 104 stream causes the cover 106 to lift from the upper end of the first pipe 102 thereby forming an orifice 110. The orifice 110 increases in width to form a larger opening for the gas 104 stream when the pressure is high, and decreases in width when the gas 104 pressure is low. In one embodiment, the foregoing may be configured as an eight inch nominal size first pipe, and the diameter of the flat bottom portion of the cover is twelve inches.

A second pipe 140 having an upper end and a lower end is concentrically positioned around the first pipe 102. The upper end of the second pipe 140 is positioned at an elevation below the upper end of the first pipe 102, and the outer edge of the second pipe 140 is tangential to the flat bottom portion of the cover 106, such that the second pipe 140 is generally the same diameter as the flat bottom portion of the cover 106. Accordingly, when the gas 104 exiting the upper end of the first pipe 102 does not have sufficient force to raise the cover off the upper end of the first pipe 102, the flat bottom portion of the cover 106 forms a cap over the upper end of the first pipe 102 but the exit area of the second pipe 140 remains open. The second pipe 140 surrounding the first pipe 102 forms an annulus and, in some embodiments, a riser 144 is positioned to feed low pressure waste gas 142 into this annulus section.

As the low pressure waste gas 142 stream exits the orifice 111, the low pressure waste gas 142 forms a thin film which facilitates the mixing of ambient air with the low pressure waste gas 142, thereby reducing the propensity of the low pressure waste gas 142 to generate smoke. However, when the outside diameter of the second pipe 140 is the same as the flat bottom portion of the cover 106, the exit area for gas through the annulus formed between the first pipe 102 and the second pipe 140 may be over-sized and may lead to low exit velocity of the low pressure waste gas 142 stream which, in turn, results in the generation of additional smoke. To increase the exit velocity of the low pressure waste gas, a horizontal choke plate 146 may be installed near the exit area of the upper end of the second pipe 140. The choke plate 146 reduces the exit area of the annulus between the first pipe 102 and the second pipe 140, thereby increasing the exit velocity of the low pressure waste gas 142 stream as much as available pressure permits. While the cross section of the choke plate 146 shown in FIG. 2 is a square, the cross section of choke plate 146 may be rectangular, triangular or other shape to create the desired flow pattern from the upper end of the second pipe.

A typical high pressure/low pressure tandem flare such as that shown in FIG. 2 requires disposal of a much higher flow rate through the first pipe 102 than the second pipe 140. For example, a typical tandem flare may dispose of 30 million standard cubic feet per day (MMSCFD) of a high pressure waste gas, while only disposing of and 0.5-1 MMSCFD of low pressure waste gas. The high pressure waste gas is smokeless in its full range due to the variable-orifice design. The assist medium required for the smokeless disposal of the low pressure waste is very low due to the low flow rate of the low pressure waste gas. This is an advantage of the current invention compared to prior-art flares.

In various embodiments of the present invention, a larger cylindrical shroud 150 is concentrically positioned around the first pipe 102, the second pipe 140, the igniter 120 and at least a portion of the cover 106. The shroud 150 constitutes the outer shell of the flare for purposes of calculating, for example, the exit velocity of gas flowing through the flare to establish compliance with applicable law. The use of a shroud that encompasses not only the first pipe 102 but also the igniter 120 is unique to this flare tip. Even when the high pressure waste gas is flowing through orifice 110 at a sonic velocity, since orifice 110 is internal to the flare tip and upstream to the exit of the flare, and the exit velocity of the high pressure waste gas based on the cross sectional area of shroud 150 is less than 400 ft/sec, this flare is in compliance with the U.S. regulations.

In addition to forming the outer shell of the flare tip, the addition of the shroud 150 allows ambient air to be drawn into the shroud 150 from the bottom opening of the shroud 150 by the induction effects of the high pressure waste gas 104. The shroud 150 also prevents cross wind from carrying away the low pressure waste gas 142 as the low pressure waste gas 142 exits the orifice 111 at a low velocity. In fact, when the high pressure waste gas 104 is flowing, there is no need for air assistance or gas assistance because the high pressure waste gas 104 alone is able to draw enough air into the shroud 150 through induction to suppress smoke formation from the low pressure waste gas 142 stream. Of course, when high pressure waste gas is turned off entirely, some form of assistance medium, such as air or steam or gas, will be required to ensure smokeless disposal of the low pressure waste gas 142 stream.

Those skilled in the art will appreciate that, while existing air-assisted or gas-assisted flares in the market utilize fixed orifice flare tips for the high pressure side of a tandem flare and, therefore, require air or gas assistance to ensure the high pressure side remains smokeless, the present invention utilizes a variable orifice which eliminates the need for an assist medium—either air or gas—for the high pressure waste gas stream to be smokeless during the operation of the flare. As a result, the amount of smoke emitted from the flare is dependent only on the ability to control the smoke generated from the combustion of the low pressure waste gas 142.

Figure 3:
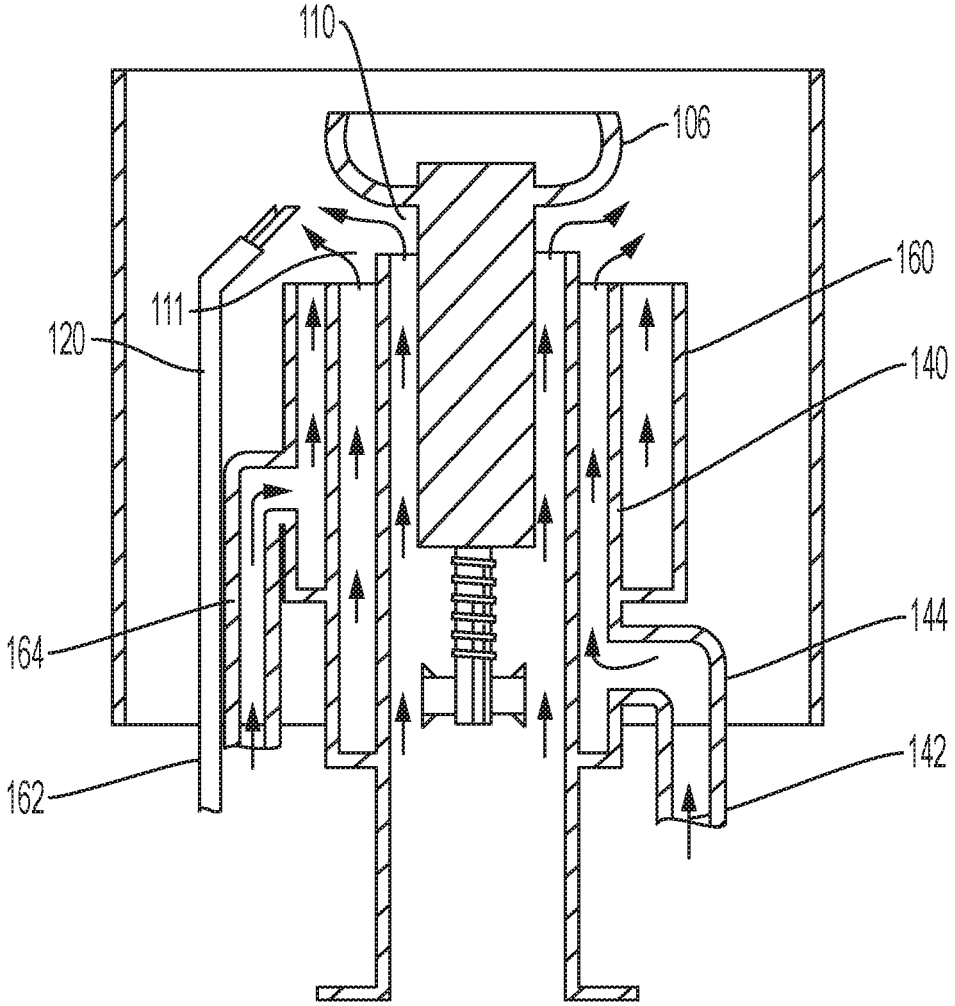
FIG. 3 shows an embodiment of an air-assisted flare tip of the present invention.

In order to facilitate the combustion of the low pressure waste gas, an air moving mechanism may be positioned around the second pipe 140 inside the shroud 150. Referring now to FIG. 3, which shows one embodiment in which an air duct 160 is concentrically positioned around the second pipe 140. Because ambient air is introduced to aid in the combustion of the low pressure waste gas 142, this configuration is referred to as an air-assisted flare.

The air duct 160 surrounding the second pipe 140 forms an annulus and, in some embodiments, an air riser 164 is positioned to feed auxiliary air 162 from, for example, an air blower (not shown), into this annulus section. Auxiliary air 162 is fed into the air riser 164 to combine with the low pressure waste gas 142, which passes through the second pipe 140 to the flare tip. Upon mixing, the auxiliary air 162 causes turbulence in the low pressure waste gas 142 stream, improving mixing, and ultimately combustion efficiency.

Figure 4:
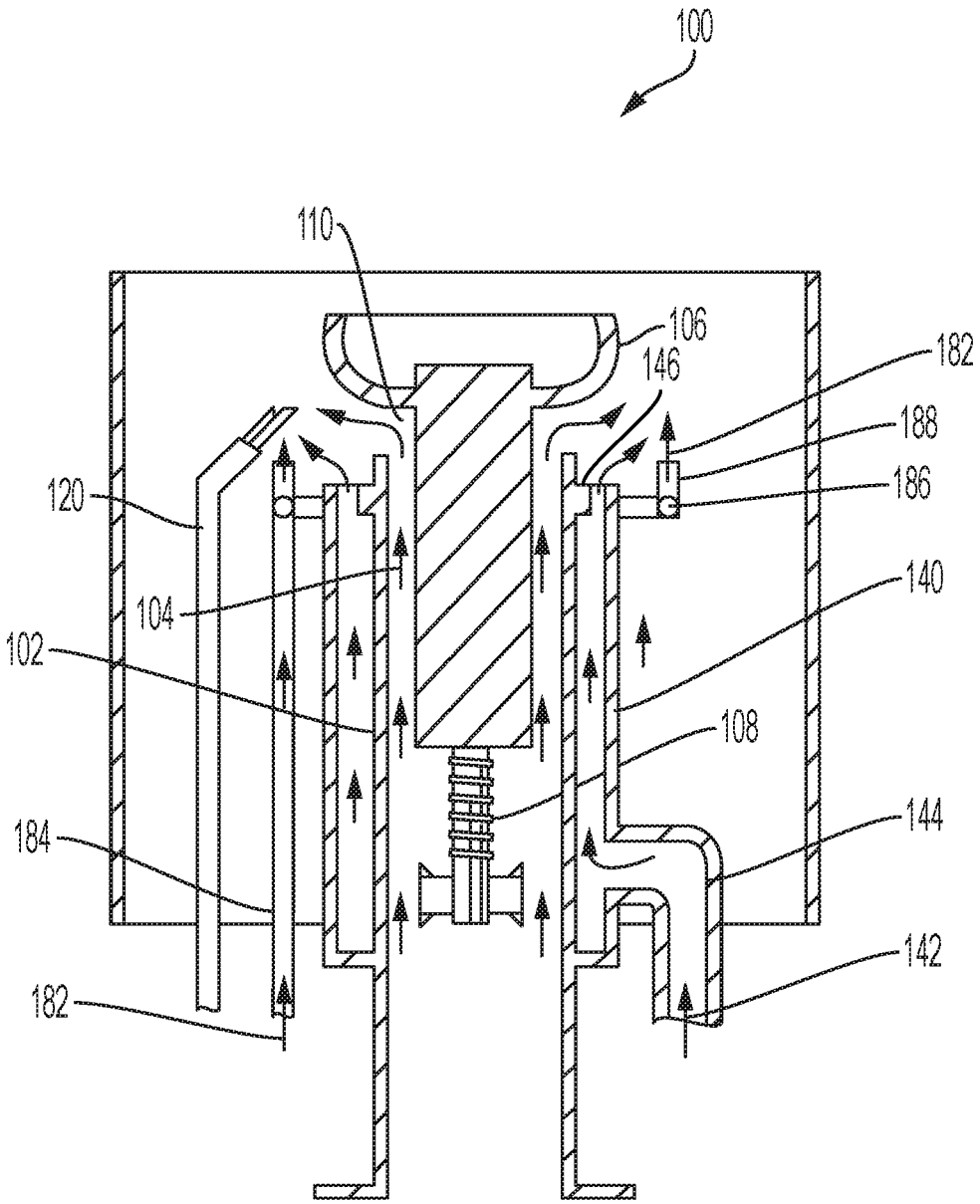
FIG. 4 shows an embodiment of a gas-assisted flare tip of the present invention.

An alternative to the air assisted flare tip is the gas-assisted flare wherein, in order to facilitate the combustion of the low pressure waste gas 142, a gas supply mechanism may be positioned around the second pipe 140 inside the shroud 150. One embodiment of the gas-assisted flare of the present invention is shown in FIG. 4. Rather than an air duct being concentrically positioned around the second pipe 140, a gas ring 186 with injection nozzles is concentrically positioned around the second pipe 140.

The gas ring 186 surrounding the second pipe 140 forms a torus section and a gas riser 184 is positioned to feed gas 182 into this torus section. Gas 182 is fed into the gas riser 184, passes through the gas ring 186 and exits the nozzles 188 to combine in the combustion zone, which may extend from the exit area of the second pipe 140 upward past the exit area of the first pipe 102 to the upper end of the shroud 150, with the low pressure waste gas 142. Each of the nozzles 188 on gas ring 186 has ports that are sized to allow the gas 182 to exit at high velocities (e.g. sonic velocities). The gas 182 entrains ambient air into the waste gas 142 and causes turbulence in the low pressure waste gas 142 stream, once again improving mixing, and ultimately combustion efficiency.

Figure 5A:
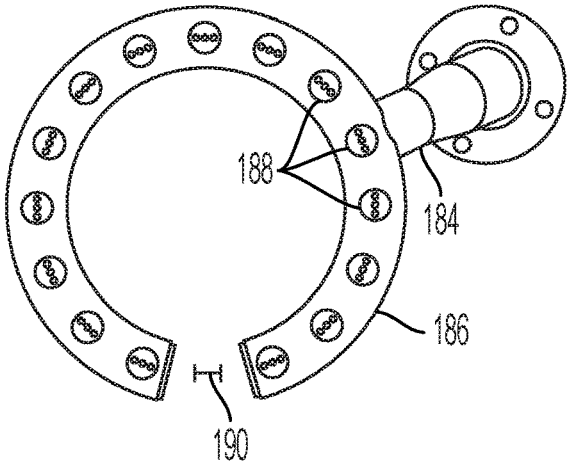
FIG. 5A shows a top view of one embodiment of a gas ring used in connection with a gas-assisted flare tip of the present invention.
Figure 5B:
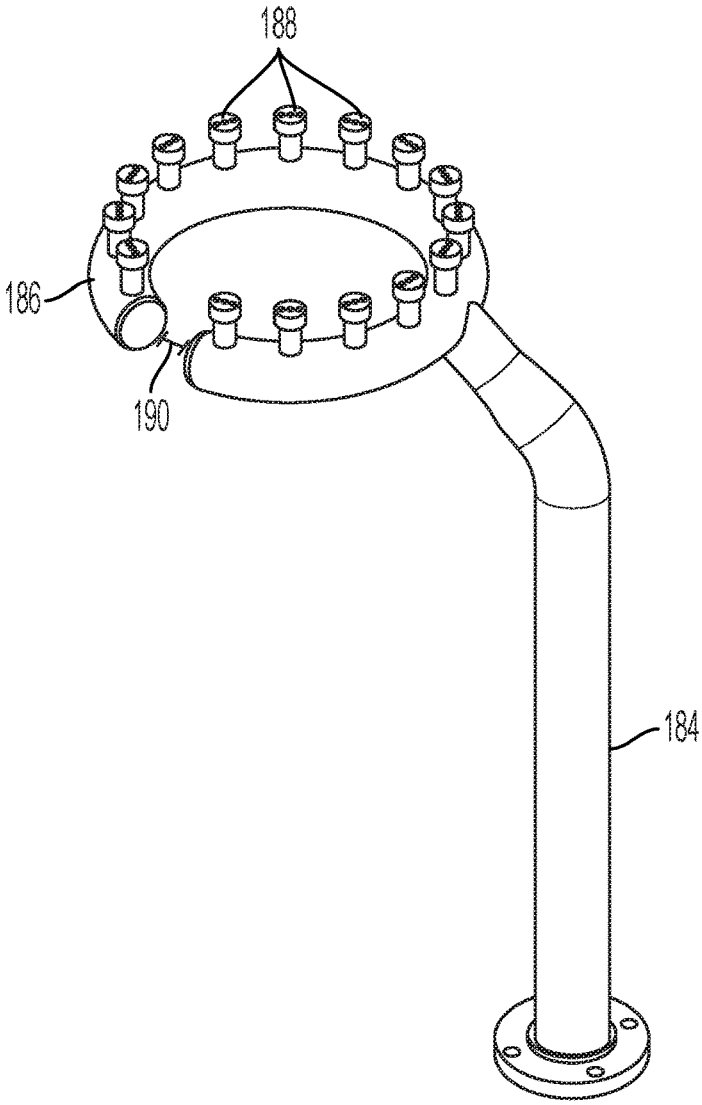
FIG. 5B shows an isometric view of one embodiment of a gas ring used in connection with a gas-assisted flare tip of the present invention.

It's important to note that the gas may be presented to the combustion zone in a variety of manners. For example, in one embodiment, shown in FIGS. 5A and 5B, the gas ring 186 forms a partial torus around the second pipe leaving a gap 190. The igniter 120 is then positioned in gap 190 so that gas 182 emitted from nozzles 188 does not interfere with the flame emitted from the igniter 120.

As will be appreciated by those skilled in the art, the use of assist air, or assist gas, in the present invention is directed to the smokeless operation of the low pressure waste gas and there is no need to use either assist medium for the high pressure side. Therefore, the demand for either air or gas as an assist medium will be reduced dramatically, which is one advantage of the present invention. In many instances, the blower horsepower consumption for an air-assisted flare, and the assist gas consumption rate for a gas-assisted flare, may be reduced by a 50-90%.

As will also be appreciated by those skilled in the art, another benefit of the present invention is the fact that, rather than the angled configuration of the typical flare when is use, the flare flame of the present invention stands more upright thereby reducing the amount heat radiating from the flare to the surrounding equipment and personnel.

While the present system and method has been disclosed according to the preferred embodiment of the invention, those of ordinary skill in the art will understand that other embodiments have also been enabled. Even though the foregoing discussion has focused on particular embodiments, it is understood that other configurations are contemplated. In particular, even though the expressions "in one embodiment" or "in another embodiment" are used herein, these phrases are meant to generally reference embodiment possibilities and are not intended to limit the invention to those particular embodiment configurations. These terms may reference the same or different embodiments, and unless indicated otherwise, are combinable into aggregate embodiments. The terms "a", "an" and "the" mean "one or more" unless expressly specified otherwise. The term "connected" means "communicatively connected" unless otherwise defined.

When a single embodiment is described herein, it will be readily apparent that more than one embodiment may be used in place of a single embodiment. Similarly, where more than one embodiment is described herein, it will be readily apparent that a single embodiment may be substituted for that one device.

In light of the wide variety of methods for utilizing industrial flares known in the art, the detailed embodiments are intended to be illustrative only and should not be taken as limiting the scope of the invention. Rather, what is claimed as the invention is all such modifications as may come within the spirit and scope of the following claims and equivalents thereto.

None of the description in this specification should be read as implying that any particular element, step or function is an essential element which must be included in the claim scope. The scope of the patented subject matter is defined only by the allowed claims and their equivalents. Unless explicitly recited, other aspects of the present invention as described in this specification do not limit the scope of the claims.

We claim:

1. A flare tip comprising:

a first pipe having an upper end and a lower end, the first pipe positioned substantially vertically and having high pressure waste gas flowing therethrough and out of the upper end thereof;

a cover positioned over the upper end of the first pipe having a widest part of the cover, wherein pressure exerted by the high pressure waste gas exiting the upper end of the first pipe causes the cover to separate from the upper end of the first pipe thereby forming an orifice through which the high pressure waste gas exits the first pipe;

a second pipe having an outer diameter the same size as the widest part of the cover, an upper end and a lower end, the second pipe concentrically positioned around the first pipe and having low pressure waste gas flowing therethrough and out of the upper end thereof, the upper end of the second pipe being positioned at a lower elevation than the upper end of the first pipe allowing said low pressure waste gas to exit the upper end of the second pipe freely even when the cover is seated on the upper end of the first pipe; and an igniter for igniting the high pressure waste gas and the low pressure waste gas.

2. The flare tip of claim 1, wherein the orifice increases in width to form a larger opening for the high pressure waste gas when the pressure of the high pressure waste gas is high, and decreases in width when the pressure of the high pressure waste gas is low.

3. The flare tip of claim 1, wherein the pressure of the high pressure waste gas flowing through the first pipe is greater than 12 psig.

4. The flare tip of claim 1, wherein the pressure of the low pressure waste gas flowing through the second pipe is less than 1 psig.

5. The flare tip of claim 1, further including a large cylindrical shroud concentrically positioned around the first pipe, the second pipe, the igniter, and at least a portion of the cover.

6. The flare tip of claim 1, further having a choke plate positioned at the upper end of the second pipe, thereby increasing the exit velocity of the low pressure waste gas exiting therefrom.

7. The flare tip of claim 1, further including a cylindrical shroud having an upper end and a lower end concentrically positioned around the first pipe, the second pipe, the igniter, and at least a portion of the cover, wherein the shroud allows ambient air to be drawn into the lower end of the shroud by an induction effect of the high pressure waste gas.

8. The flare tip of claim 1, further including an air duct having an upper end and a lower end, the air duct concentrically positioned around the second pipe and having auxiliary air flowing therethrough and out of the upper end thereof, wherein auxiliary air exiting the air duct mixes in a combustion zone with low pressure waste gas exiting the upper end of the second pipe.

9. The flare tip of claim 1, further including a cylindrical shroud having an upper end and a lower end concentrically positioned around the first pipe, the second pipe, the igniter, and at least a portion of the cover, wherein the shroud constitutes an outer shell of the flare tip for purposes of determining compliance with regulations.

10. The flare tip of claim 1, further including a cylindrical shroud having an upper end and a lower end concentrically positioned around the first pipe, the second pipe, the igniter, and at least a portion of the cover, wherein when the velocity of high pressure waste gas exiting the first pipe exceeds 400 ft/second the velocity of high pressure waste gas exiting the upper end of the shroud is less than 400 ft/second.

11. The flare tip of claim 1, further including a gas supply mechanism having a torus shaped ring concentrically positioned at least partially around the second pipe and having nozzles extending upwardly therefrom, wherein gas flows through the gas supply mechanism and out of the nozzles whereupon gas exiting the nozzles mixes in a combustion zone with low pressure waste gas exiting the upper end of the second pipe.

12. The flare tip of claim 1, further including a gas supply mechanism having a torus shaped ring concentrically positioned at least partially around the second pipe and having nozzles extending upwardly therefrom, wherein gas flows through the gas supply mechanism and out of the nozzles whereupon gas exiting the nozzles mixes in a combustion zone with low pressure waste gas exiting the upper end of the second pipe.

* * * * *